US006767226B2

(12) United States Patent
Varatta

(10) Patent No.: US 6,767,226 B2
(45) Date of Patent: Jul. 27, 2004

(54) PREMOLDING ELECTRICAL RECEPTACLES

(75) Inventor: Thomas R. Varatta, Johnston, RI (US)

(73) Assignee: ETCO Incorporated, Warwick, RI (US)

( * ) Notice: Subject to any disclaimer, the term of this patent is extended or adjusted under 35 U.S.C. 154(b) by 0 days.

(21) Appl. No.: 10/085,448

(22) Filed: Feb. 28, 2002

(65) Prior Publication Data

US 2003/0162423 A1 Aug. 28, 2003

(51) Int. Cl.[7] ..... H01R 13/58
(52) U.S. Cl. ..... 439/106; 439/606
(58) Field of Search ..... 439/106, 606, 439/736, 686, 695

(56) References Cited

U.S. PATENT DOCUMENTS

| | | | | | |
|---|---|---|---|---|---|
| 5,221,211 | A | * | 6/1993 | Leong | 439/106 |
| 5,411,403 | A | * | 5/1995 | Blanche | 439/106 |
| 5,647,751 | A | * | 7/1997 | Shulman et al. | 439/106 |
| 5,662,484 | A | * | 9/1997 | Blanche | 439/106 |
| 6,168,443 | B1 | * | 1/2001 | Mullen, Jr. et al. | 439/106 |
| 6,190,212 | B1 | * | 2/2001 | Brown et al. | 439/106 |
| 6,227,916 | B1 | * | 5/2001 | Wu | 439/606 |
| 6,290,512 | B1 | * | 9/2001 | Mullen, Jr. et al. | 439/106 |

* cited by examiner

*Primary Examiner*—Gary Paumen

(57) ABSTRACT

A premold for a receptacle for an electrical male plug includes valving means on particular contact cooperative valving portions and through ground pin receptacle expansion.

10 Claims, 3 Drawing Sheets

PREMOLDING ELECTRICAL RECEPTACLES

This invention relates to receptacles for electrical plugs, and more particularly to premolds for use in the manufacture thereof.

BACKGROUND

Prior art premolds for plug receptacles have incorporated bent, slotted "blades", as does the present invention, but have required two rigid polyvinyl plastic elements, ultrasonically welded together, a requirement greatly more labor intensive than the present invention.

SUMMARY

It has been discovered that incorporating a "gate" in the blades, on one half and working with the other as its seat, a receptacle premold may be provided with great efficiency and greatly diminished labor intensity.

In another aspect, it has been discovered that a ground receptacle may be gated by combining a longitudinal outwardly extending rib with an opposed longitudinal split to work in combination with a mold load pin.

DRAWINGS

Figure 1:
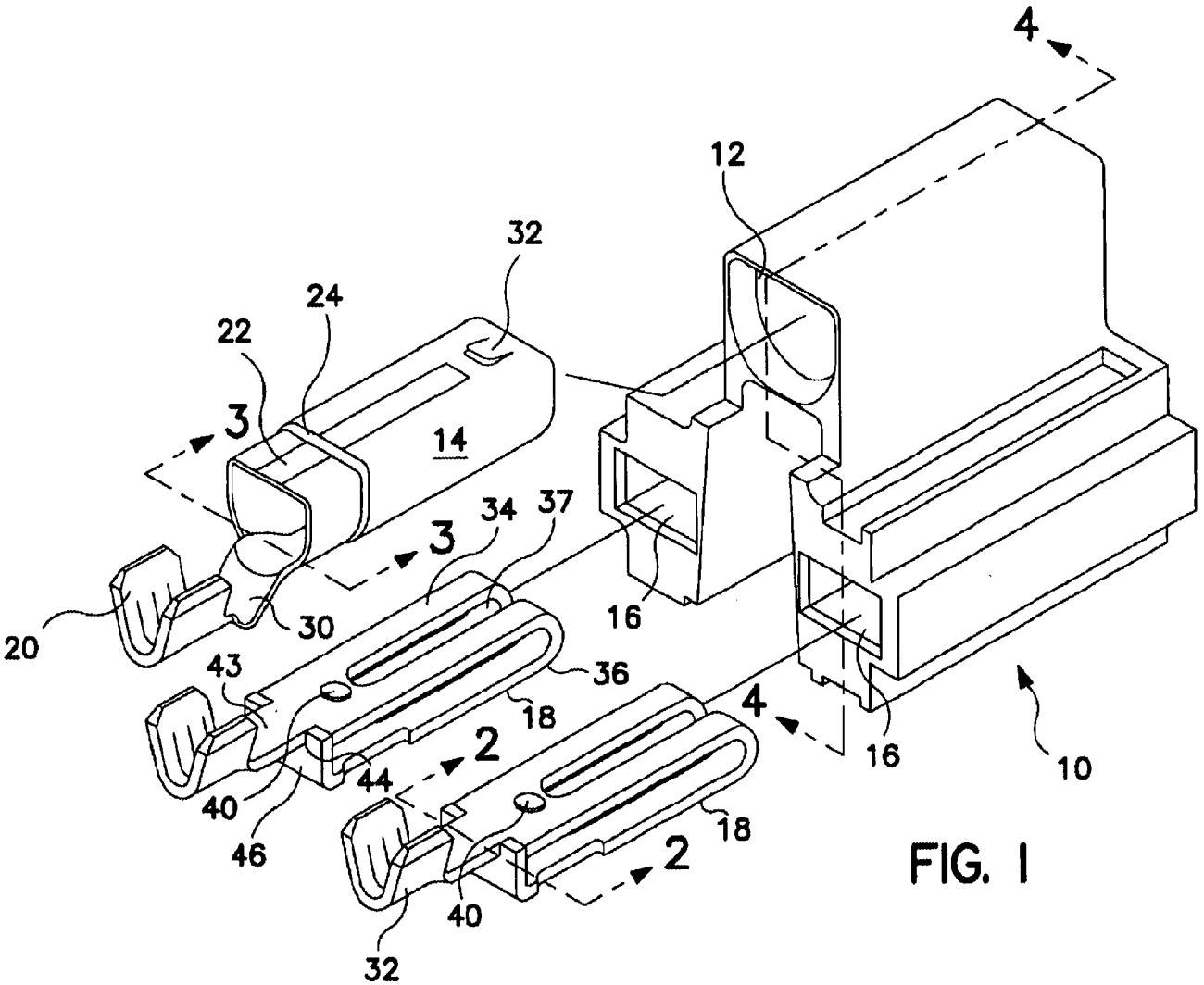
Figure 3:
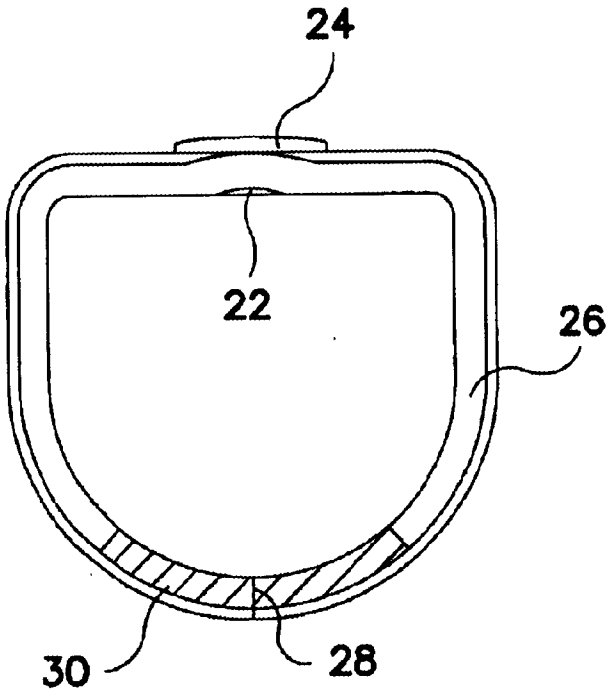
Figure 2:
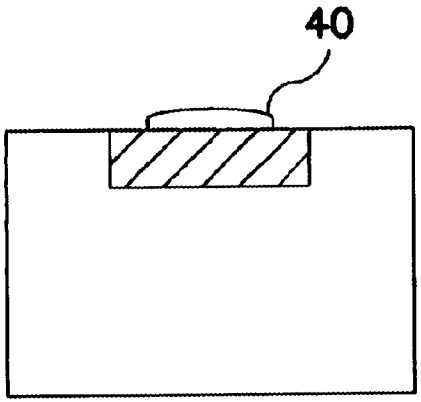
Figure 4:
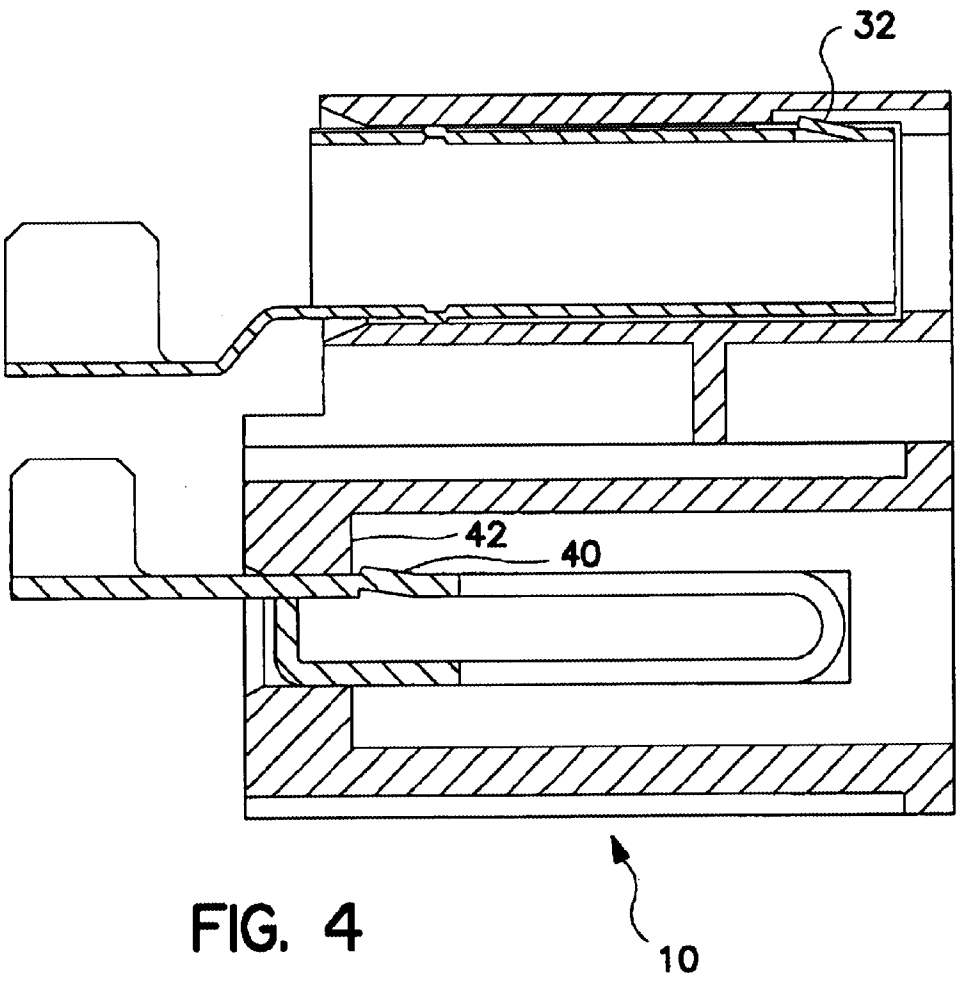

Turning now to the presently preferred embodiment of the invention, there is shown in:

FIG. 1, an exploded isometric view thereof;

FIG. 2, a sectional view at 2—2 of one element of FIG. 1;

FIG. 3, a sectional view at 3—3 of another portion of FIG. 1; and in FIG. 4, a sectional view at 4—4 of the plastic housing of said embodiment.

DESCRIPTION

Shown in FIG. 1 is a rigid plastic housing 10, molded conventionally of a polycarbonate composition and including an opening 12 for a ground pin contact 14 and two openings 16 for identical contact pins 18.

Each ground pin 14 includes a cup 20 for crimping around a wire bundle, an outwardly directed cylindrical indentation 22 (which facilitates use alternatively with a round ground pin), a peripheral circumferential outwardly extending rib 24 and is formed of flat sheet stock formed into abutting unsealed relation at joint 28. Neck 30 joins cup 20 to the rest of the contact. Flexible inclined plane stop 32 prevents a pin from backward movement.

Each contact pin 18 includes a wire crimp cup and a blade portion 34 bent at one end 36 to provide two generally parallel sheets intermediately correspondingly slotted (at 37) to accept one blade of the pair carried by a male electric plug. Each pin 18 also carries an inclined plane stop 40 to engage abutment 42 to prevent backward movement of the pin.

A narrower tongue 43 at the end of one of said sheets engages notch 44 of "door" 46 at the corresponding end of the other of those sheets to prevent flow of plastic in overmolding. Resilience of this blade and of the housing 10 (despite its relative rigidity in cooperating with pin stops) may provide a spring action useful in biasing the two portions of the contact pins toward each other.

In overmolding, conventionally, mold load pins are used conventionally to close housing holes 50, 52, and 54, except that the load pin closing hole 54 in the present invention extends also into ground pin 14 to expand its circumference through cooperation with rib 24 and slot 28. The aftermold die surrounds the entire premold assembly shown in FIG. 1.

This invention also facilitates the mounting of a neon light bulb in a premold itself: all that need be done is to interpose its two wires between two male blade receptacle portions 34 and the adjacent housing portions.

I claim:

1. A plug receptacle premold which comprises:

a rigid plastic housing, said housing comprising first and second contact pin holes, and first and second contact pins, at least one of said pins having male-blade-spaced portions at one end and at the other end cooperative valving and seating portions.

2. The premold of claim 1 in which said portions are arranged for resilient biasing toward each other.

3. A plug receptacle premold which comprises:

a rigid plastic housing, said housing comprising first and second contact pin holes, and first and second contact pins, said pins having male-blade-spaced portions at one end and at the other end cooperative valving and seating portions.

4. The premold of claim 3 in which said valving portion is a tongue and said seating portion is a notch.

5. The premold of claim 1 which also includes a ground pin receptacle, said receptacle including a longitudinal embossment adapted to facilitate use therewith of a round ground pin.

6. The premold of claim 1 which also includes a ground pin receptacle, said receptacle including a circumferential rib and a longitudinal gap.

7. A contact element for restricting flow of overmold into said element which comprises:

a body portion and a valving portion, said valving portion in use restricting said flow, in which said element includes also a seating portion.

8. The element of claim 7 which said body portion is a longitudinally intermediately folded integral unit thin relative to its transverse width and including a blade-receptive slot extending from the fold at said folded location inwardly thereof, said slot being correspondingly sized and oriented with respect to each body portion from said fold, each said body portion being spaced from the other suitably to jointly provide a female contact for a male plug blade, and which also includes a valve portion and a seat portion, at facing ends of said body portion away from said fold.

9. The element of claim 7 in which said valving portion is carried by said body portion.

10. The element of claim 9 in which said body portion is the annulus of a cylinder in cross-section and said valving portion is a peripheral rib extending outwardly thereof, said body portion including a longitudinal split.

* * * * *